252-102 AU 157 EX
5/6/86 XE 4,586,961

United States Patent [19]
Bradley et al.

[11] Patent Number: 4,586,961
[45] Date of Patent: May 6, 1986

[54] METHODS AND COMPOSITIONS FOR REMOVING COPPER AND COPPER OXIDES FROM SURFACES

[75] Inventors: Gary W. Bradley; Stephen T. Arrington, both of Duncan, Okla.

[73] Assignee: Halliburton Company, Duncan, Okla.

[21] Appl. No.: 701,899

[22] Filed: Feb. 15, 1985

[51] Int. Cl.[4] ..... C23G 1/02
[52] U.S. Cl. ..... 134/2; 134/29; 252/80; 252/102; 252/156
[58] Field of Search ..... 134/2, 29; 252/80, 102, 252/156

[56] References Cited

U.S. PATENT DOCUMENTS 780,293 1/1905 Joseph .
2,567,835 9/1951 Alquist et al. ..... 134/2
3,000,767 9/1961 Elliott .
3,034,851 5/1962 Dustman ..... 252/102 X
3,460,989 8/1969 Rusch .
3,664,870 5/1972 Oberhofer et al. ..... 134/3
3,738,867 6/1973 Franz ..... 252/102 X
4,452,643 6/1984 Martin et al. .

*Primary Examiner*—Jeanette Hunter
*Attorney, Agent, or Firm*—Edward F. Sherer

[57] ABSTRACT

Methods and compositions for removing copper and copper oxide deposits from metal surfaces including surfaces formed of austenitic, nickel-chromium and other similar alloys without adversely affecting such surfaces are provided. The copper and copper oxide deposits are dissolved in an aqueous ammoniacal cleaning solution which includes one or more alkali metal or ammonium perborate oxidizing agents.

15 Claims, No Drawings

METHODS AND COMPOSITIONS FOR REMOVING COPPER AND COPPER OXIDES FROM SURFACES

BACKGROUND OF THE INVENTION

1. Field of the Invention

This invention relates to methods and compositions for removing copper and copper oxides from surfaces, and more particularly, to methods and compositions for dissolving copper and copper oxide deposits whereby alloy surfaces contacted by the compositions are not adversely affected thereby.

2. Description of the Prior Art

In process equipment such as steam boilers, feed water heaters, heat exchangers and pressure vessels in which water is circulated, water insoluble salts commonly deposit on the interior metal surfaces of such equipment. The formation or deposition of scale deposits can markedly reduce the heat transfer and/or the capacity of flow passages in the equipment.

In process equipment which includes or is associated with components constructed of copper alloys, the scale produced on internal surfaces is frequently found to contain copper and copper oxides. A variety of methods and compositions have been developed and used heretofore for removing such copper and copper oxide deposits. For example, one method which has been employed for removing copper and copper oxide scale deposits from ferrous metal surfaces is to initially contact the surfaces with an ammoniacal oxidant wash, such as an ammoniacal solution containing ammonium persulfate or sodium bromate to remove part of the copper deposits followed by contacting the surfaces with a cleaning solution containing an acid plus a copper complexing material. The copper complexing material functions to tie up the remaining copper so that it is dissolved and held in the cleaning solution. While such multi-stage cleaning procedures have been used successfully, they are generally expensive to carry out.

Another method of removing copper and copper oxides from ferrous metal surfaces is disclosed in U.S. Pat. No. 4,452,643 issued June 5, 1984. That method comprises contacting copper and copper oxide deposits with an aqueous composition having a pH of from about 3 to about 6 comprised of an oxidizing agent, preferably hydrogen peroxide, a compound selected from the group consisting of oxalic acid and the alkali metal and ammonium salts of oxalic acid and an ingredient selected from the group consisting of citric acid, polyaminocarboxylic acid, the ammonium and alkali metal salts of citric acid and polyaminocarboxylic acids and mixtures thereof.

While the above described methods have been utilized successfully in removing copper and copper oxide deposits from ferrous metal surfaces, in some process equipment such as nuclear steam generators, some of the internal surfaces are formed of alloys such as austenitic steel alloys, alloys of nickel, iron and chromium, alloys of nickel and chromium and other similar alloys. It has been found that when these alloys are contacted with copper and copper oxide scale removal cleaning solutions containing strong oxidizing agents, e.g., sodium bromate and ammonium persulfate, the alloys can be adversely affected such as by the occurrence of stress corrosion cracking. That is, sodium bromate is believed to cause cracking of austenitic stainless steel and other alloys due to the presence of bromide in the spent solution. Ammonium persulfate is believed to cause intergranular attack of nickel-chromium alloys due to the presence of sulfur. In addition, ammonium persulfate is unstable at temperatures above about 110° F., sodium bromate contains a form of the element bromine which can cause personnel hazards and hydrogen peroxide is unstable in some cleaning solutions.

By the present invention an improved copper and copper oxide cleaning solution is provided which does not adversely affect surfaces of formed of austenitic, nickel-chromium and other similar alloys when contacted therewith. In addition, the cleaning solution, and particularly the oxidizing agent utilized therein, is more economical than heretofore used solutions and oxidizing agents.

DESCRIPTION OF PREFERRED EMBODIMENTS

The method of the present invention for removing copper and copper oxide deposits without adversely affecting austenitic, nickel-chromium and other similar alloy surfaces is comprised of the steps of contacting the deposits with an aqueous ammoniacal cleaning solution for a period of time sufficient to dissolve the deposits therein followed by the removal of the cleaning solution containing the dissolved deposits from the surfaces. The aqueous ammoniacal cleaning solution contains one or more water soluble perborate oxidizing agents, e.g., alkali metal and ammonium perborates, which do not adversely affect austenitic, nickel-chromium and other similar alloys. The perborate oxidizing agent or agents function in the ammoniacal cleaning solution to oxidize free copper in contacted deposits whereby copper oxide is formed. Copper oxide originally contained in the deposits and the newly formed copper oxide are readily dissolved in the ammoniacal solution.

While the aqueous ammoniacal solution of this invention can contain a variety of components in addition to the water soluble perborate oxidizing agent or agents, such as chelating or complexing agents, e.g., ammonia, ethylenediaminetetracetic acid (EDTA) or ethylenediamine (EDA), a particularly preferred cleaning solution is comprised of an aqueous solution containing ammonia, ammonium bicarbonate and one or more water soluble perborates.

A particularly preferred and suitable cleaning solution of the present invention for removing copper and copper oxide deposits without adversely affecting alloy surfaces contacted therewith is comprised of water, ammonia present in the solution in an amount in the range of from about 0.05% to about 15% by weight of the solution, ammonium bicarbonate present in the solution in an amount in the range of from about 0.04% to about 10% by weight of the solution and one or more water soluble perborates, preferably sodium perborate, present in the solution in an amount in the range of from about 0.05% to about 5% by weight of the solution.

The most preferred such aqueous cleaning solution has a pH of about 10.5 and contains ammonia in an amount of about 9.7% by weight of the solution, ammonium bicarbonate in an amount of about 10% by weight of the solution, and sodium perborate in an amount of about 1% by weight of the solution.

The ammoniacal-perborate solution can be used for dissolving copper and copper oxide deposits without adversely affecting austenitic stainless steel and nickel-chromium alloys at temperatures from ambient up to about 150° F. The preferred temperature range at which the cleaning solution is brought into contact with copper and copper oxide deposits to be dissolved is between about 120° F. and about 150° F. At these temperatures and the component concentrations set forth above, the aqueous ammoniacal cleaning solution is non-corrosive to ferrous metal surfaces and surfaces formed of the alloys mentioned above.

The aqueous cleaning solutions of this invention are brought into contact with copper and copper oxide deposits and the surfaces containing such deposits using any suitable technique, e.g., static soaking, pouring, spraying or circulating. Preferably, the cleaning solution is circulated over the surfaces to be cleaned at the preferred temperatures mentioned above, the circulation being continued until the copper and copper oxide deposits are dissolved in the solution.

The quantity of cleaning solution required and the time the solution should remain in contact with the copper and copper oxide deposits depends on the quantity of the deposits to be removed. In cleaning vessels, heat exchangers and the like, to insure adequate contact with all surfaces to be cleaned, sufficient cleaning solution is introduced into the vessel, exchangers, etc., whereby they are filled. The solution is then preferably slowly circulated by pumping to insure continuous contact with all surfaces to be cleaned. From time to time additional amounts of the cleaning solution can be added to the original quantity placed within the equipment so that the capacity of the cleaning solution for dissolving the copper and copper oxide deposits will be sufficient. The circulation of the cleaning solution is generally carried out at a pressure slightly in excess of atmospheric pressure and after the copper and copper oxide deposits have been dissolved, the cleaning solution is drained from the equipment being cleaned and the equipment is flushed with fresh water.

The ammoniacal cleaning solutions of this invention can be prepared in any suitable manner with care being taken to prevent spillage or contact with personnel or oxidizable materials. If concentrates of the cleaning solution are prepared, they should be contained in containers lined with non-metallic corrosion resistant material in that in concentrated form, the solutions can decompose on ferrous metal surfaces. To prevent decomposition, the concentrates should not be mixed in advance of their intended use. In a preferred technique for preparing the cleaning solutions, fresh water at a temperature in the range of from about 120° F. to about 150° F. is first mixed with ammonium bicarbonate such as by agitating or circulating the water in a tank while adding the ammonium bicarbonate thereto. After the ammonium bicarbonate has dissolved in the water, the alkali metal perborate oxidizing agent or agents utilized are added to the solution while continuing to agitate the solution in the tank. Once the ammonium bicarbonate and perborate oxidant are dissolved, ammonia, preferably in the form of an aqueous solution containing about 30% by weight ammonia is added to the tank while agitating or circulating the tank. The resulting concentrated solution is diluted with hot water as it is pumped into the vessel or system to be cleaned.

As mentioned above, when the vessel or system to be cleaned is filled to operating level, the cleaning solution can be slowly circulated or it can be allowed to contact the interior surfaces and the deposits to be removed therefrom in a static or relatively static condition. Provision should be made to allow any gases formed during the dissolution of the deposits to escape from the system. In static treatments, intermittent agitation is recommended, either by circulation, drain-back or injection of air or nitrogen. During the treatment, the copper content of the cleaning solution can be monitored to assure the solution remains active, and when the copper content stops increasing, additional active solution can be circulated into the system if required or the treatment will be completed.

If during the treatment, the pH of the cleaning solution falls below about 9.5, more ammonia should be added to the cleaning solution to assure continued copper dissolution and to prevent replating of dissolved copper. Once the treatment has been completed and the copper and copper oxide deposits removed, a fresh water flush is carried out in the cleaned equipment to prevent copper ions remaining therein from being replated during subsequent cleaning stages or operation of the equipment.

In order to facilitate a clear understanding of the methods and compositions of this invention, the following examples are given.

EXAMPLE 1

In order to compare sodium perborate ($NaBO_3.4H_2O$) to sodium bromate ($NaBrO_3$) and ammonium persulfate [$(NH_4)_2S_2O_8$] when present in ammoniacal copper solvents, a series of tests are performed using various copper and copper oxide cleaning solutions. The solutions are prepared by blending the various components thereof including the particular oxidizing agent utilized with water. The solutions are placed in plastic or glass beakers and one copper and one mild steel corrosion coupon are added to each of the beakers. The coupons are prepared as follows:

Coupon Preparation Procedure

1. Stamp coupon for identification;
2. Degrease coupon in acetone;
3. Bead blast coupon with 35 psig. air pressure to remove any corrosion products present on the coupon surface;
4. Rinse coupon in acetone and allow to air dry; and
5. Weigh coupon to nearest 0.001 gram and record this weight as initial weight.

After placement of the coupons in the test cleaning solutions, the beakers are capped with a self-venting lid in all tests not involving air blows. In tests involving air blows of the solution, a two-hole stopper is used as a cap for the beakers. A sintered glass air sparger is inserted through one hole and air is introduced at this point while the other hole serves as a vent. The beakers are placed in thermostated water baths for test time periods after which the coupons are removed and cleaned according to the following procedure:

Post-Test Coupon Cleaning Procedure

1. Scrub coupon lightly with steel wool pad and mild soap;
2. Rinse coupon in tap water;
3. Rinse coupon in deionized water;
4. Rinse coupon in acetone and allow to air dry; and
5. Weigh coupon to nearest 0.001 gram and record this weight as final weight.

The results of these tests are shown in Tables I and II below. In the Tables, the corrosion rates are calculated using the following formulas:

$$\text{Weight Loss (gm.)} = \text{Initial Weight (gm.)} - \text{Final Weight (gm.)}$$

$$\text{Corrosion Rate (lbs./ft.}^2\text{/day)} = \frac{\text{Weight Loss (gm.)} \times 24}{\text{Coupon surface area (ft.}^2) \times \text{Test Length (hrs.)} \times 454}$$

TABLE I

A Comparison of the Copper Dissolving Capabilitites of Ammoniacal Solutions Containing Sodium Perborate with Solutions Containing Sodium Bromate

| | |
|---|---|
| Temperature: | 150° F. |
| Coupon Surface Area: | 4.37 in.$^2$ |
| Velocity: | static |
| Volume: | 10 ml. |
| Test Length: | 6 hours |

| Test No. | Solvent | mpl. Cu | Mild Steel Corrosion Rate (lb./ft$^2$/day) |
|---|---|---|---|
| 1 | 0.2 wt. % sodium perborate + 0.16 wt. % ammonium bicarbonate + 0.75 wt. % ammonia | 1163 | 0.0001 |
| 2 | 0.2 wt. % sodium bromate 0.16 wt. % ammonium bicarbonate + 0.75 wt. % ammonia | 1000 | Wt. Gain |

TABLE II

A Comparison of the Copper Dissolving Capabilities of Ammonium Bicarbonate Solutions Containing Sodium Perborate with Solutions Containing Ammonium Persulfate

| | |
|---|---|
| Solvent Volume: | 100 ml. |
| Velocity: | static |
| Coupon Surface Area: | 4.37 in.$^2$ |

| Test No. | Solvent | mpl. Cu | Mild Steel Corrosion Rate (lb./ft.$^2$/day) |
|---|---|---|---|
| 1 | 10 wt. % ammonium bicarbonate + 9.67 wt. % ammonia + 1 wt. % sodium perborate at 150° F. for 6 hours | 1,963 | 0.0014 |
| 2 | Repeat Test No. 1 with 2 wt. % sodium perborate | 4,056 | 0.0026 |
| 3 | Repeat Test No. 1 with 3 wt. % sodium perborate | 4,900 | 0.0014 |
| 4 | 10 wt. % ammonium bicarbonate + 9.67 wt. % ammonia + 0.5 wt. % sodium perborate at 150° F. for 24 hours with airblow | 98,375[1] | 0.0121 |
| 5 | 10 wt. % ammonium bicarbonate + 9.67 wt. % ammonia + 0.5 wt. % sodium perborate at 100° F. for 24 hours with airblow | 98,375 | 0.0014 |
| 6 | 10 wt. % ammonium bicarbonate + 9.67 wt. % ammonia + 1 wt. % ammonium persulfate at 100° F. for 24 hours with airblow | 102,550 | <0.001 |

[1]Large quantities of copper oxides were present on the copper coupons upon test conclusion. A coating of copper oxides was also present on the mild steel coupons.
[2]All airblows at 5 c.c/min.

As shown by Tables I and II, sodium perborate functions as an oxidizing agent in ammoniacal cleaning solutions equivalently to sodium bromate and/or ammonium persulfate. All of the various cleaning solutions tested functioned well in dissolving copper while being relatively non-corrosive to mild steel.

EXAMPLE 2

Pilot tests are conducted utilizing a pot boiler circulation system consisting of a large carbon steel vessel through which solvents can be circulated under controlled conditions. The solvent volume used in each test is 45 liters and solvent circulation is maintained at 4 liters per minute during the course of each test.

An aqueous solution containing about 3% by weight citric acid, ammonia in a quantity such that the pH of the solution is adjusted to 3.5, 0.376% by weight copper sulfate and 0.1% of a corrosion inhibitor (OSI-1 sold by Halliburton Services of Duncan, Oklahoma) is injected into the pot boiler and circulated at 200° F. to produce a copper plating on the internal surfaces of the boiler. The plating represents about 67 grams of copper and following the plating, the boiler is rinsed with deionized water. The copper solvents tested are circulated through the boiler after plating in each test. The results of these tests are present in Table III below.

TABLE III

Comparison of an Ammoniacal Copper Solvent Utilizing Sodium Perborate as an Oxidant with an Equivalent Solvent Containing Sodium Bromate

| | |
|---|---|
| Solvent: | 0.15 wt. % oxidant + 0.12 wt. % ammonium bicarbonate + 0.61 wt. % ammonia |
| Temperature: | 150° F. |
| Solvent Volume: | 45 liters |
| Circulation Rate: | 4 liters per minute |

| Time (hrs.) | Oxident: sodium perborate mpl. Cu | Oxident: sodium bromate mpl. Cu[1] |
|---|---|---|
| 2 | 460 | 835 |
| 4 | 587 | 500 |
| 6 | 640 | 525 |
| 8 | 675 | 450 |
| 10 | 775 | 430 |
| 12 | 795 | 405 |
| 14 | 957 | 385 |
| 16 | 910 | 255 |
| 18 | 1157 | 365 |
| 20 | 1222 | 225 |
| 22 | 1390 | 390 |
| 24 | 1430 | 430 |
| 26 | 1510 | — |

[1]Heavy deposits of CuO were present on all metal surfaces in contact with the solvent following this test.

The data presented in Table III shows that sodium perborate dissolved in excess of 0.15 wt.% copper after 24 hours of contact time. The interior surfaces of the pot boiler were inspected after the test and were determined to be free of copper with no rusting or precipitation.

EXAMPLE 3

An actual boiler tube section containing scale deposits is obtained and the scale analyzed. The results of the analysis are given in Table IV below.

TABLE IV

Analysis of Deposit in Boiler Tube Section

| | |
|---|---|
| **X-ray Diffraction Analysis** | |
| Copper (Cu): | Major |
| Cuprous Oxide ($Cu_2O$): | Moderate |
| Magnetite ($Fe_3O_4$): | Moderate |
| Cupric Oxide (CuO): | Small |
| **X-ray Fluorescence Analysis** | |
| Magnesium | 1-3 |
| Aluminum | <1 |

TABLE IV-continued

| Analysis of Deposit in Boiler Tube Section | |
|---|---|
| Silicon | 1.5–4.5 |
| Phosphorous | 1.5–4.5 |
| Sulfur | 0.4–1.2 |
| Calcium | 1.5–4.5 |
| Chromium | <0.05 |
| Manganese | 0.05–0.15 |
| Iron | 17–25 |
| Nickel | 2–6 |
| Copper | 35–45 |
| Zinc | 0.1–0.3 |

The boiler tube section is cut into smaller pieces which are subjected to cleaning treatments consisting of contact with an aqueous ammoniacal oxidant solution for copper removal followed by contact with an aqueous hydrochloric acid solution for iron oxide removal followed by a second contact with an aqueous ammoniacal oxidant solution for the removal of residual copper.

In one test the oxidant used is sodium bromate and in a second test the oxidant used is sodium perborate. The results of these tests are given in Table V below.

TABLE V

Results of Solvent Tests on Boiler Tube Pieces
All Tests Conducted with 200 ml. of Solvent
Under Static Conditions at 150° F. for 6 Hours

| Test No. | Treatment | Results |
|---|---|---|
| 1 | 0.1 wt. % Ammoniacal Bromate Solution[1] followed by 5 wt. % Hydrochloric Acid + 0.1 wt. % Corrosion Inhibitor[2] followed by 0.1 wt. % Ammoniacal Bromate Solution[1] | 435 mpl. Cu<br>3320 mpl. Fe<br>217 mpl. Cu<br>Tube Clean |
| 2 | 0.1 wt. % Ammoniacal Perborate Solution[3] followed by 5 wt. % Hydrochloric Acid + 0.1 wt. % Corrosion Inhibitor[2] followed by 0.1 wt. % Ammoniacal Perborate Solution[3] | 390 mpl. Cu<br>3230 mpl. Fe<br>237 mpl. Cu<br>Tube Clean |

[1]Ammoniacal bromate solution is comprised of 0.1 wt. % sodium bromate + .078 wt. % ammonium bicarbonate + 0.3 wt. % ammonia.
[2]Rodine 213 corrosion inhibitor sold by Amchem Products, Inc. of Ambler, Pennsylvania.
[3]Ammoniacal perborate solution is comprised of 0.1 wt. % sodium perborate + .078 wt. % ammonium bicarbonate + 0.3 wt. % ammonia.

As shown in Table V, sodium perborate is an equivalent oxidizing agent in aqueous ammoniacal copper solvent to sodium bromate.

EXAMPLE 4

In the pot boiler system described in Example 2, a simulated sludge deposit is produced by mixing 900 grams of technical grade copper powder with 300 grams of technical grade magnetite ($Fe_3O_4$) powder. The simulated sludge is placed in the bottom of the boiler and an aqueous ammoniacal cleaning solution is injected into the pot and circulated at a rate of 1 gpm. The solvent is heated to 150° F. and maintained at such temperature for the first 20 hours of the test.

The cleaning solution is analyzed periodically throughout the test, the results of which are given in Table VI below.

TABLE VI

Analysis of First Copper Stage

| | |
|---|---|
| Solvent: | 1 wt. % Sodium Perborate + 10 wt. % Ammonium Bicarbonate + 9.67 wt. % ammonia |
| Solvent Volume: | 45 liters |
| Temperature: | 150° F. |
| Circulation Rate: | 4 liters per minute |
| Pot Loading: | 900 gm. Cu Powder and 300 gm. $Fe_3O_4$ Powder |

| Elapsed Time, Hours | mpl. Cu | Grams Cu Removed | Remarks |
|---|---|---|---|
| 0 | 0 | 0 | Sodium perborate = 1.0 wt. % |
| 2 | 925 | 41 | Sodium perborate = 0.02 wt. %, add 0.5% Sodium perborate |
| 3 | — | — | Sodium perborate = 0.04 wt. %, begin airblow at 2 liters minute |
| 4 | 1,355 | 60 | |
| 8 | 2,535 | 114 | |
| 12 | 3,050 | 137 | |
| 16 | 4,500 | 202 | |
| 20 | 5,225 | 235 | Reduce temperature to 100° F., Reduce airblow to 1 liter minute |
| 30 | 6,400 | 288 | |
| 50 | 7,375 | 331 | |
| 86 | 10,300 | 463 | |
| 122 | 10,400 | 468 | |
| 158 | 10,900 | 490 | Add 4 lb of 30% Ammonium Hydroxide + 0.5% sodium perborate at 166 hours |
| 190 | 12,200 | 549 | |
| 214 | 12,200 | 549 | |

Approximately 1 wt.% copper is dissolved in the cleaning solution during the first 100 hours of contact with the solution.

After the test described above is completed, the pot boiler is filled with a cleaning solution for removing iron oxide, namely, an aqueous solution containing 10 wt.% ethylenediaminetetracetic acid (EDTA), 0.5 wt.% hydrazine, ammonium hydroxide in an amount to adjust the pH to 6.0, and 0.6 wt.% corrosion inhibitor (OSI-1 sold by Halliburton Services of Duncan, Oklahoma). This solvent is circulated at 200° F. for 44 hours and dissolves approximately 3200 mpl. iron. This iron concentration represents 198 grams of dissolved magnetite.

A deionized water rinse is injected into the pot boiler following the iron removal stage. This rinse is circulated through the boiler for 30 minutes and then drained to waste. A fresh solution of copper cleaning solution is prepared at ambient temperatures and circulated through the boiler in the same manner as in the first stage. The results of the second copper removal test are given in Table VII below.

TABLE VII

Analysis of Second Copper Stage

| | |
|---|---|
| Solvent: | 1 wt. % Sodium Perborate + 10 wt. % Ammonium Bicarbonate + 9.67 wt. % Ammonia |
| Solvent Volume: | 45 liters |
| Temperature: | 100° F. |
| Circulation Rate: | 4 liters per minute |
| Pot Loading: | 900 gm. Cu Powder and 300 gm. $Fe_3O_4$ Powder |

| Elapsed Time, Hours | mpl. Cu | Grams Cu Removed | Remarks |
|---|---|---|---|
| 2 | 475 | 21 | Gas evolution almost nil |
| 3 | — | — | Initiate 2 liters/minute airblow |

TABLE VII-continued

| Analysis of Second Copper Stage | | |
|---|---|---|
| 4 | 710 | 31 |
| 8 | 900 | 40 |
| 16 | 1,355 | 60 |
| 32 | 2,030 | 91 |
| 48 | 2,825 | 127 |
| 64 | 3,675 | 165 |
| 80 | 4,200 | 189 |
| 96 | 5,225 | 235 |
| 112 | 5,550 | 249 |
| 128 | 5,725 | 257 |
| 142 | 5,875 | 264 |
| 146 | 5,875 | 264 |

The three-stage treatment removes 90 wt.% of the copper and 66 wt.% of the magnetite. Table VIII below sets forth a summary of the entire test sequence.

TABLE VIII

Summary of Deposits Removed During Entire Test Sequence

| | |
|---|---|
| Boiler Loading: | 900 gm. Cu & 300 gm. $Fe_3O_4$ |
| System Volume: | 45 liters |
| Circulation Rate of All Solvents: | 1 gm. |

| Stage No. | Solvent | Deposit Removed |
|---|---|---|
| 1 | 1 wt. % Sodium Perborate + 10 wt. % Ammonium Bicarbonate + 9.67 wt. % Ammonia, at 150° F. with 2 liters/min. airblow for 20 hours followed by 100° F. and 1 liter/min. airblow for 194 hours | 549 gm. Cu |
| 2 | 10 wt. % EDTA + 0.5 wt. % hydrazine + Ammonia + 0.6 wt. % Corrosion Inhibitor[1] at 200° F. for 44 hours | 198 gm. $Fe_3O_4$ |
| 3 | 1 wt. % Sodium Perborate + 10 wt. % Ammonium Bicarbonate + 9.67 wt. % Ammonia, at 100° F. with 2 liters/min. airblow for 146 hours | 264 gm. Cu |
| | TOTAL | 813 gm. Cu<br>198 gm. $Fe_3O_4$ |

[1]OSI-1 sold by Halliburton Services of Ducan, Oklahoma

What is claimed is:

1. A method of removing copper and copper oxide deposits from austenitic or nickel-chromium alloy surfaces containing such deposits comprising contacting said deposits with an aqueous ammoniacal solution consisting essentially of a water soluble perborate oxidizing agent.

2. The method of claim 1 wherein said oxidizing agent is sodium perborate.

3. The method of claim 2 wherein said aqueous ammoniacal solution further consists essentally of ammonia and ammonium bicarbonate.

4. The method of claim 3 wherein said ammonia is present in said solution in an amount in the range of from about 0.05% to about 15% by weight of said solution, said ammonium bicarbonate is present in said solution in an amount in the range of from about 0.04% to about 10% by weight of said solution and said sodium perborate is present in said solution in an amount in the range of from about 0.05% to about 5% by weight of said solution.

5. A method of dissolving copper and copper oxide deposits from austenitic or nickel-chromium alloy surfaces in a cleaning solution without adversely affecting said surfaces comprising contacting said deposits with an aqueous ammoniacal cleaning solution consisting essentially of:

water;

ammonia present in said solution in an amount of about 9.7% by weight of said solution;

ammonium bicarbonate present in said solution in an amount of about 10% by weight of said solution; and one or more alkali metal or ammonium perborate oxidizing agents present in said solution in an amount of about 1% by weight of said solution.

6. The method of claim 5 wherein said oxidizing agent is sodium perborate.

7. A method of removing copper and copper oxide deposits from austenitic or nickel-chromium alloys surfaces containing said deposits without adversely affecting said surfaces comprising the steps of:

contacting said surfaces containing said deposits with an aqueous ammoniacal cleaning solution consisting essentially of one or more alkali metal or ammonium perborate oxidizing agents; and removing said cleaning solution from contact with said surfaces after said deposits have dissolved therein.

8. The method of claim 7 wherein said oxidizing agent is sodium perborate.

9. The method of claim 8 wherein said aqueous ammoniacal solution further consists essentially of ammonia and ammonium bicarbonate.

10. The method of claim 9 wherein said ammonia is present in said solution in an amount in the range of from about 0.05% to about 15% by weight of said solution, said ammonium bicarbonate is present in said solution in an amount in the range of from about 0.04% to about 10% by weight of said solution and said sodium perborate is present in said solution in an amount in the range of from about 0.05% to about 5% by weight of said solution.

11. The method of claim 9 wherein said ammonia is present in said solution in an amount of about 9.7% by weight of said solution, said ammonium bicarbonate is present in said solution in an amount of about 10% by weight of said solution, and said sodium perborate is present in said solution in an amount of about 1% by weight of said solution.

12. A cleaning solution for removing copper and copper oxides from metal surfaces formed of austenitic or nickel-chromium alloys without adversely affecting said surfaces consisting essentially of water;

ammonia present in said solution in an amount in the range of from about 0.05% to about 15% by weight of said solution;

ammonium bicarbonate present in said solution in the range of from about 0.04% to about 10% by weight of said solution; and one or more alkali metal or ammonium perborate oxidizing agents present in said solution in an amount in the range of from about 0.05% to about 5% by weight of said solution.

13. The cleaning solution of claim 12 wherein said oxidizing agent is sodium perborate.

14. The cleaning solution of claim 13 wherein said ammonia is present in said solution in an amount of about 9.7% by weight of said solution, said ammonium bicarbonate is present in said solution in an amount of about 10% by weight of said solution, and said sodium perborate is present in said solution in an amount of about 1% by weight of said solution.

15. The cleaning solution of claim 14 wherein the pH of said solution is about 10.5.

* * * * *